US006296234B1

(12) United States Patent
De Boer

(10) Patent No.: US 6,296,234 B1
(45) Date of Patent: Oct. 2, 2001

(54) CRUSH BARRIER

(76) Inventor: Robert De Boer, Jongedijk 6, NL-8771 KJ Nijland (NL)

( * ) Notice: Subject to any disclaimer, the term of this patent is extended or adjusted under 35 U.S.C. 154(b) by 0 days.

(21) Appl. No.: 09/371,779

(22) Filed: Aug. 10, 1999

(51) Int. Cl.[7] ..... E04H 17/01
(52) U.S. Cl. ..... 256/64
(58) Field of Search ..... 256/64, 63, 59, 256/35, 36, 26, 25, 24, 31, 27

(56) References Cited

U.S. PATENT DOCUMENTS

| | | | | |
|---|---|---|---|---|
| 3,107,900 | | 10/1963 | De Paolo . | |
| 4,909,483 | * | 3/1990 | van Herpen | 256/59 |
| 4,979,725 | * | 12/1990 | Hutchings, II et al. | 256/64 |
| 5,356,119 | | 10/1994 | Schock . | |
| 5,599,006 | * | 2/1997 | Gevaux et al. | 256/25 |
| 5,722,642 | * | 3/1998 | Bradshaw | 256/24 X |

FOREIGN PATENT DOCUMENTS

| | | |
|---|---|---|
| 641 118 | 9/1993 | (AU) . |
| 2 228 510 | 8/1990 | (GB) . |

* cited by examiner

*Primary Examiner*—Lynne H. Browne
*Assistant Examiner*—John Cottingham
(74) *Attorney, Agent, or Firm*—Young & Thompson

(57) ABSTRACT

The present invention relates to a crush barrier, comprising a support and an essentially vertically positioned flat screen, fixed to said support. The crush barrier according to the invention is characterized in that said support forms an essentially rectangular flat element that is hingebly connected to said support with the aid of one or more arms, the various features being such that the screen is able to hinge from a folded-down position essentially parallel to the support into an opened-out position essentially transverse to the support.

5 Claims, 4 Drawing Sheets

CRUSH BARRIER

BACKGROUND OF THE INVENTION

The present invention relates to a crush barrier, comprising a support and an essentially vertically positioned flat screen, fixed to said support.

In the prior art crush barriers are usually used to form a temporary partition for people or animals. In the prior art crush barriers are usually made up of metal tubes. With this arrangement a number of horizontally positioned tubes arranged above one another form a screen which can be held in the vertical position by tubes which are positioned transversely to the screen and form a support. So as to be able to form a closed partition from separate crush barriers, the crush barriers are provided at either end with coupling means, with the aid of which crush barriers positioned next to one another can be detachably fixed to one another.

A significant disadvantage of the crush barriers according to the prior art is the poor handling characteristics of the crush barriers. Firstly, the crust barriers according to the prior art from a rigid construction. The known crush barriers are therefore difficult to stand take up a relatively large amount of space during storage and transport. Secondly, the known crush barriers are usually made of steel and are therefore relatively heavy.

SUMMARY OF THE INVENTION

The aim of the present invention is to provide a crush barrier with the aid of which, in use, a safe and reliable partition can be constructed, the crush barriers being of relatively lightweight and compact construction.

Said aim is achieved in the present invention in that said support forms an essentially rectangular flat element that is hingebly connected to said support with the aid of one or more arms, the various features being such that the screen is able to hinge from a folded-down position essentially parallel to the support into an opened-out position essentially transverse to the support. The advantage of this measure is that, in use, the crust barrier according to the present invention forms a construction that requires a relatively large amount of space, whilst the crush barrier can be folded down to give a relatively compact unit during transport and storage.

Furthermore, according to the present invention it is advantageous that the crush barrier comprises two arms an essentially rectangular step, wherein said step is arranged between two arms, at one longitudinal edge thereof is hingebly fixed to said arms and at the other longitudinal edge has means with the aid of which the step can be fixed to the screen when the crush barrier is in the opened-out position.

The advantage of placing a step between the arms and the screen is firstly that the rigidity of the crush barrier in the opened-out position increases significantly. Secondly, in use, the step can be used by, for example, security personnel. When security staff take up position on the step they are standing higher than the public on the other side of the crush barrier and are therefore easily able to maintain supervision or to provide assistance.

According to the present invention, it is furthermore advantageous that, in the opened-out position, the arms and the step are located on one side of the screen, the support comprising an essentially open surface on that side of the screen and the support comprising an essentially closed surface on the other side of the screen.

In use, the public and the like will be located on one side of the crush barrier whilst the officials, security staff and the like will be located on the other side. As a result of the chosen construction, the crush barrier is free from obstacles on the public side. The general public is consequently able to take up position on the essentially closed surface of the support on the public side of the screen. As a result of the weight of the general public on the support, the crush barrier will be extra firmly fixed onto the substrate and the risk of the crush barrier falling over is minimal. Nobody has to be able to take up position on the support on the other side of the crush barrier. The support is therefore provided with an essentially open surface on this side. As a result of this measure, the weight of the support remains as low as possible.

Furthermore, according to the present invention is advantageous that the screen is provided at the bottom with lips having holes through them which, in the opened-out position of the crush barrier, are in line with the holes through the support.

Locking elements can be placed in the holes through the lips and the support. With the aid of these elements the screen can firstly be fixed in a vertical position. At the same time, two crush barriers located next to one another are fixed to one another by the locking elements. What is achieved as a result of this measure is that the crush barriers can be erected and dismantled relatively easily and quickly.

Furthermore, it is advantageous that the crush barrier is essentially made of aluminium. The crush barrier according to the present invention can be made of any suitable material. However, by constructing the crush barrier of aluminium a relatively lightweight crush barrier is produced. The ease of handling of the crush barriers improves as a result of this measure.

Furthermore, it is a advantageous that the screen is partially open. The effect of this measure is that the openings in the screen can be used for looking through the screen. Moreover, the openings can be used for feeding air and sound. If the crush barrier according to the present invention is, for example, used at pop concerts, where large groups of people are restrained with the aid of the crush barrier, these people are able to look, breathe and receive sound through the openings in the screen.

The present invention will now be described with reference to a number of figures, in which:

DESCRIPTION OF THE PREFERRED EMBODIMENTS

Figure 1:
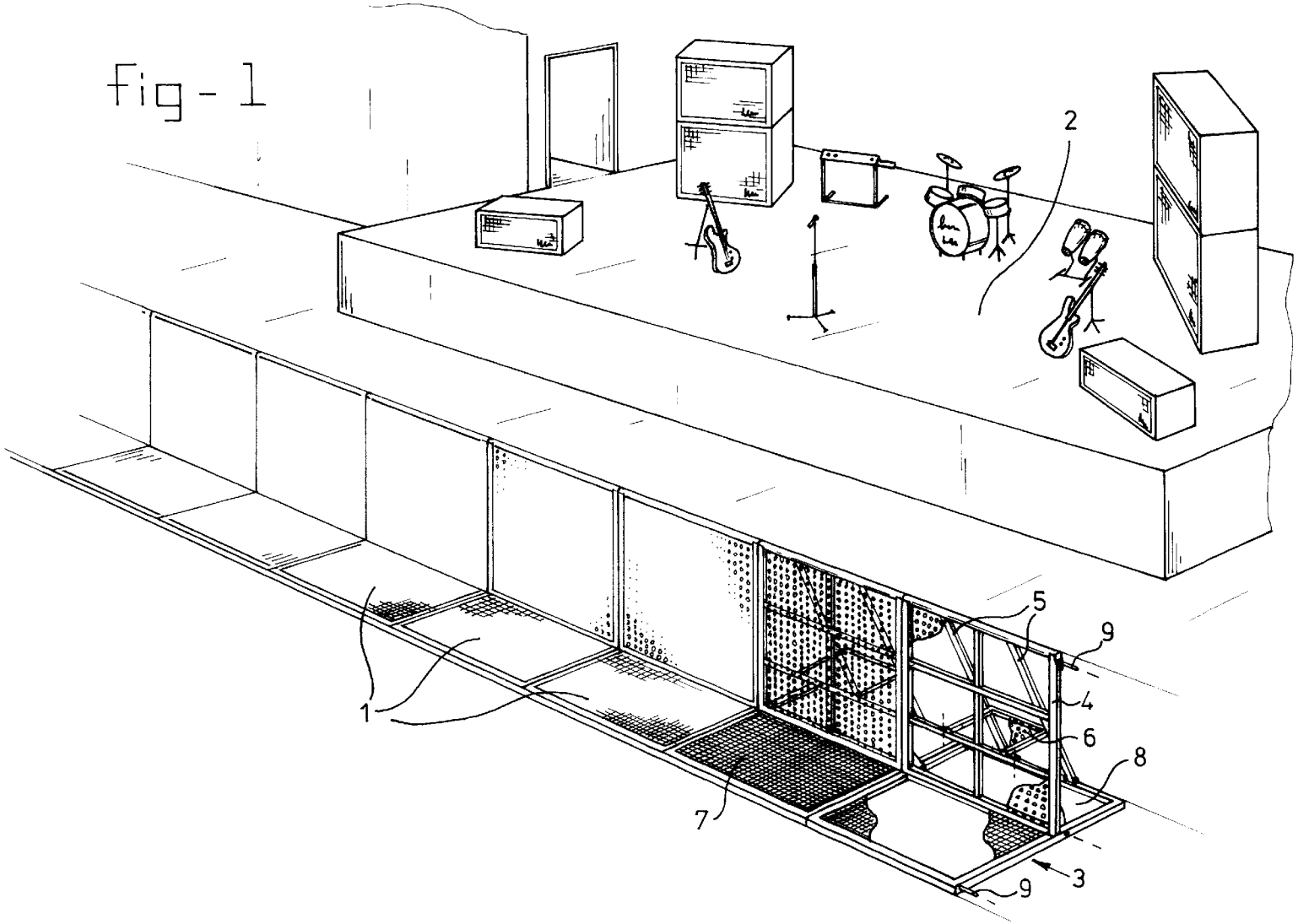
FIG. 1 shows an overview of a number of crush barriers according to the present invention which have been positioned alongside one another.

FIG. 1 shows a number of crush barriers 1 positioned alongside one another which together form a partition, for example between the public and the podium 2 during a pop concert. The crush barriers 1 comprise a support 3 and screen 4. The screen 4 is held in a vertical position with the aid of arms 5 and a step 6 placed between the arms 5 and the screen 4.

The support 3 has an essentially closed surface 7 at the front, or the 'public side'. The surface 7 consists, for example, of a grating, so that the surface 7 on the one hand can be used to allow the public to take up position thereon, whilst, on the other hand, it is possible to discharge moisture, such as rain, through the surface 7.

If a number of people take up position on the grating 7, the crush barriers 1 will be fixed extra well on the substrate as a result of the additional weight. The stability of the crush barriers 1 is appreciably increased as a result. The risk of toppling is therefore minimal.

The rear of the support 3 forms essentially an open surface 8. The advantage of this is, inter alia, that the support can be of relatively lightweight constructions as a result. Security staff or officials are, for example, located at the rear of the crush barrier during use. Said security staff or officials can, if desired, take up position on the step 6. From the step 6 the security staff are able to survey the people on the other side of the screen 4. In an emergency it is possible, for example from the step 6 also to offer assistance to people who, for example, are at risk becoming crushed against the screen 4.

The screen 4 is partially open. This can be achieved, for example, by making holes in the screen 4. The holes in the screen 4 have a number of functions. Firstly, air is able to flow through the holes, so that even the people who are standing against the screen 4 obtain a supply of fresh air. Moreover, the holes in the screen can be used for looking through the screen 4. Consequently, even short people who are standing against the screen 4 are able to see what is happening on the other side of the screen 4. The holes also serve for discharge of heat and moisture originating from the people standing against the screen 4. If the crush barriers 1 are used during a pop concert, the music is able to pass through said screen via holes.

The crush barriers 1 are preferably coupled to one another by fixing elements (not shown) which can be reached only form the rear. Said fixing means can, for example, consist of bolts and nuts, or any other suitable fixing element. Moreover, it is advantageous that said fixing elements can be rapidly assembled and rapidly disassembled without the use of tools. Consequently, the partition can not only be erected quickly but can also be disassembled quickly. This is a particularly useful feature in the event of an emergency.

Figure 6:
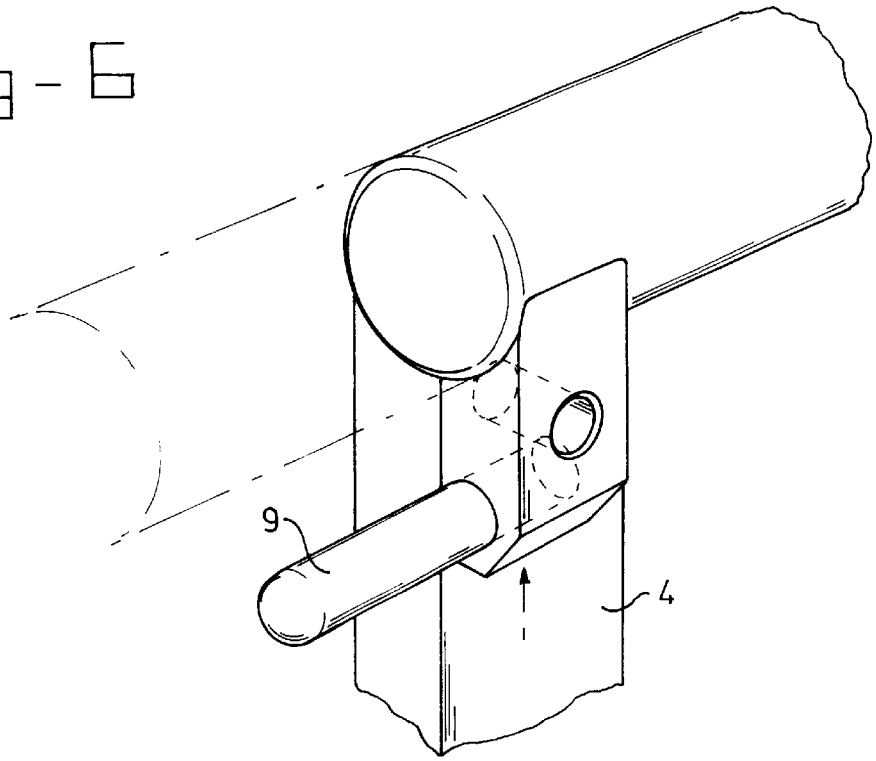
FIG. 6 is a detailed drawing of the centring pins which are fitted on the screen.

To facilitate coupling two crush barriers 1 positioned next to one another, the crush barriers are provided at one end with centring pins 9 (see also FIG. 6).

Figure 2:
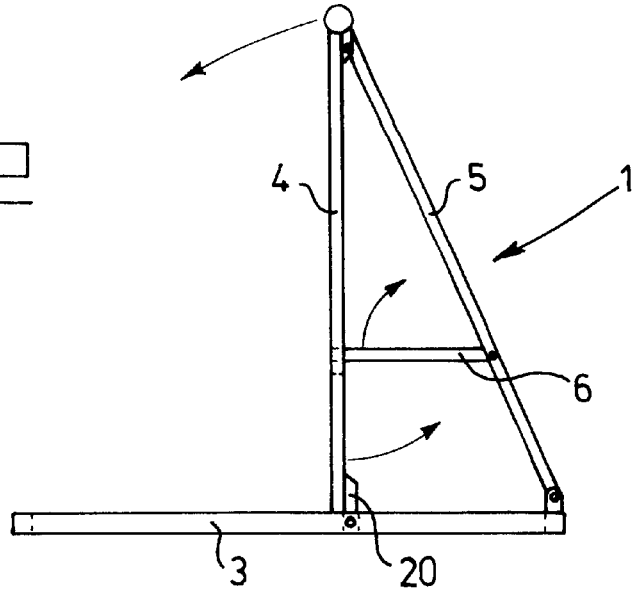
FIGS. 2, 3 and 4 show how the crush barrier according to the present invention is folded down.
Figure 3:
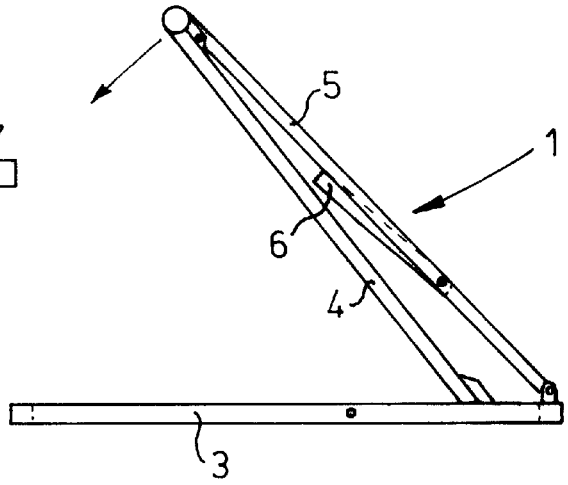
Figure 4:
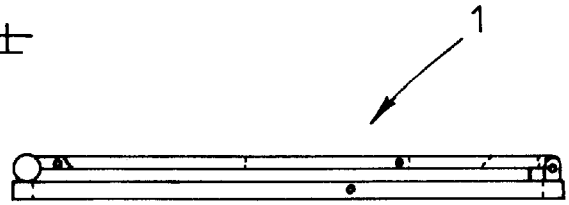

FIGS. 2, 3 and 4 show how the crush barrier 1 according to the invention is folded down. In FIG. 2 it can be seen that the screen 4 is in a vertical position with respect to the support 3. The screen 4 is held in a vertical position by the arms 5, which are hingebly connected at the top thereof to the top of the screen 4. At the bottom of the arms, the latter are hingeable connected to the support 3. Moreover, the arms 5 are connected wit the aid of the step 6 to the vertical screen 4. At the bottom of the screen 4, the latter is provided with lips 20. Said lips 20 can firstly be used as a stop when placing the screen 4 in the vertical position. Secondly, said lips 20 can be used for fixing the bottom of the screen 4 to the support 3. This is shown in detail in FIG. 7.

The screen 4 is preferably rounded at the top. The top can, for example, consist of a tube or pipe. The advantage of this measure is that people who place their hand on the top edge of the crush barrier 1 will not be able to hurt their hands on this edge. Because the top of the crush barrier is rounded, the crush barrier can be used as a support for the hands.

In FIG. 3 the crush barrier 1 according to the invention can be seen in the half folded-down position. Finally, FIG. 4 shows the crush barrier 1 according to the invention in the fully folded-down position. It can been seen from this figure that the transport and storage of crush barriers in the folded-down form takes up relatively little space.

The crush barrier 1 is preferably made of aluminium. This means that the crush barrier can be not only of compact but also of lightweight construction. Consequently the ease of handling of the crush barrier 1 is particularly good.

Figure 5:
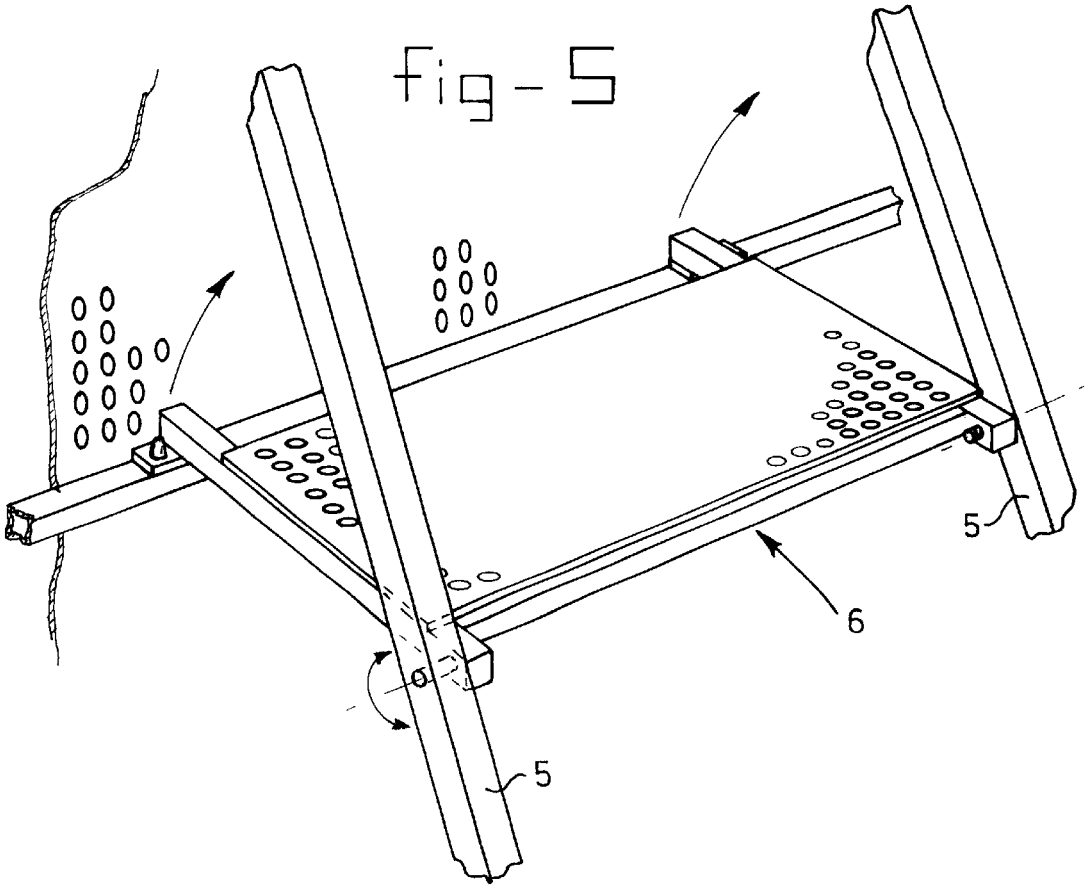
FIG. 5 is a detailed drawing of the step in the crush barrier.

The step 6 of the crush barrier 1 is shown in detail in FIG. 5 The second step 6 is hingeable connected at one end of the arms 5. At the other end the step 6 has fixing means with the aid of which said step can be fixed to the screen 4. The step is so constructed that, on folding down, the step 6 fits between the arms 5.

FIG. 6 shows the centring pin 9 with the aid of which crush barriers located next to one another can be placed against one another. At the other end of the crush barrier, the crush barriers have centring holes for making an effective connection with the centring pins 9.

Figure 7:
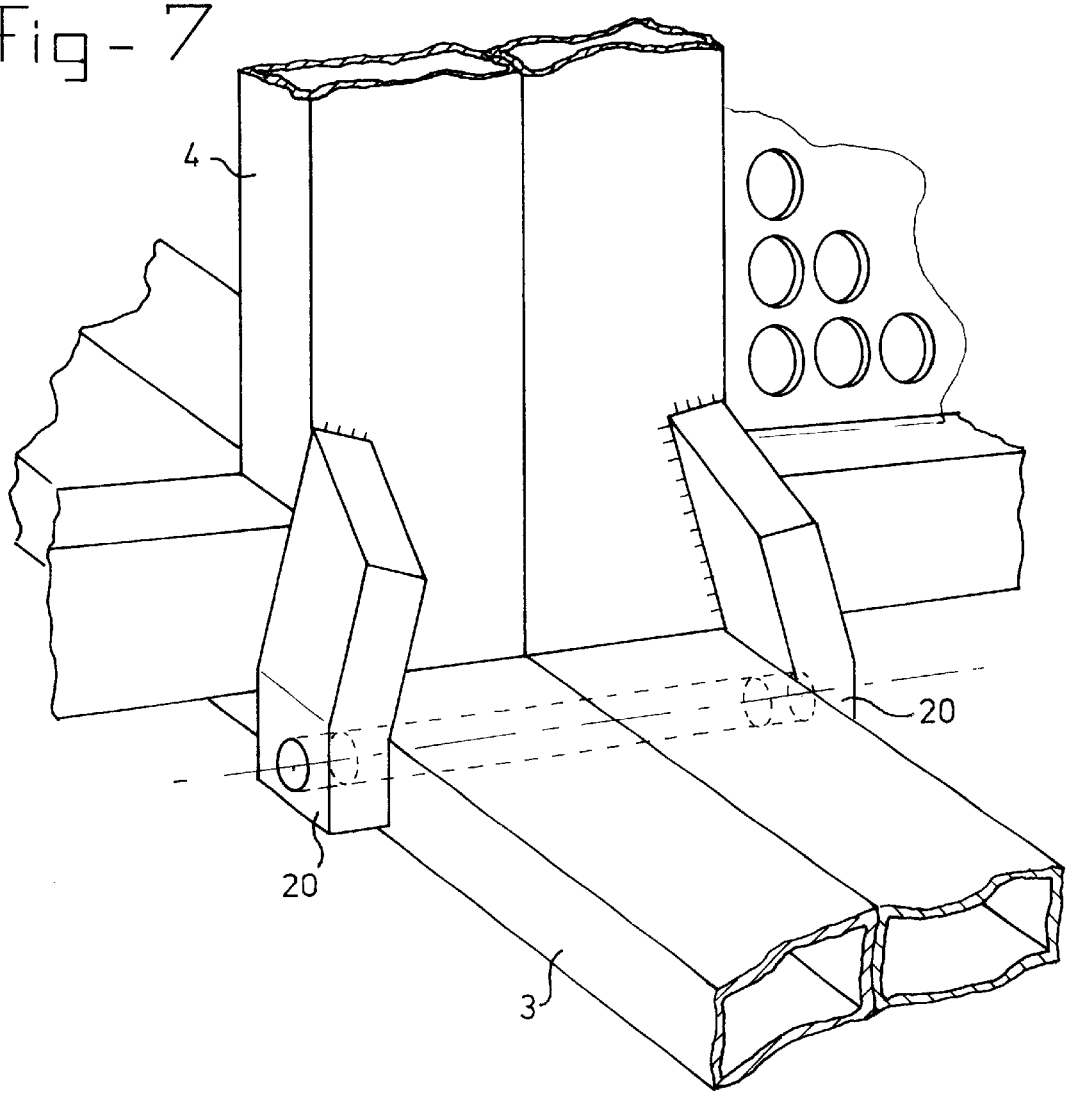
FIG. 7 is a detail view of the holes through the fixing lips and the supports.

FIG. 7 shows a detail of the fixing of two crush barriers, located next to one another, with the aid of holes which have been made through the lips 20 and the support 3. It can been seen from the figure that with the aid of the fixing means such as, for example, a bolt and a nut, two crush barriers 1 located next to one another can firstly be fixed in the opened-out position and, moreover, can be connected to one another.

What is claimed is:

1. A crush barrier comprising:

a ground support that comprises a substantially flat and rectangular frame adapted to be placed on ground where the crush barrier is to be erected;

a substantially flat barrier screen attached to said support and that is movable between a first position in which said screen is generally parallel to said support and a second position in which said screen is substantially perpendicular to said support;

arms hinged to a top of said screen and to said frame and that support said screen in the second position; and lips attached to a bottom of said screen, each of said lips having a screen alignment hole therethrough that is aligned with a corresponding hole in said frame when said screen is in the second position, the bottom of said screen being movable relative to said support to move said screen between the first and second first positions, said support having a first interior portion that is covered and a second interior portion that is open, the bottom of said screen defining a division between said first and second interior portions when said screen is in the second position.

2. The crush barrier of claim 1, wherein the top of said screen comprises a beam with a rounded top.

3. The crush barrier of claim 1, further comprising first centering holes in sides of said screen and said frame and centering pins removably inserted into said first centering holes, for attacking the crush barrier in a line with another said crush barrier.

4. The crush barrier of claim 3, further comprising second centering holes that are generally perpendicular to said first centering holes.

5. The crush barrier of claim 1, wherein each of said lips comprises a slab with a first section having said hole therethrough and a second section with a side edge affixed to a flat face of said screen that faces said second interior portion of said support when said screen is in the second portion, said first and second sections of said slab being in different planes to define an angle therebetween.

* * * * *